US008621999B1

(12) United States Patent
Wood

(10) Patent No.: US 8,621,999 B1
(45) Date of Patent: Jan. 7, 2014

(54) CORUSCATIVE WHITE LIGHT GENERATOR

(75) Inventor: James Richard Wood, Grapevine, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 114 days.

(21) Appl. No.: 13/187,047

(22) Filed: Jul. 20, 2011

Related U.S. Application Data

(60) Provisional application No. 61/371,226, filed on Aug. 6, 2010, provisional application No. 61/371,813, filed on Aug. 9, 2010.

(51) Int. Cl.
*F42B 4/26* (2006.01)

(52) U.S. Cl.
USPC ..... 102/346; 102/335

(58) Field of Classification Search
USPC ..... 102/346, 305–312, 335–336
See application file for complete search history.

(56) References Cited

U.S. PATENT DOCUMENTS

| | | | | | |
|---|---|---|---|---|---|
| 3,135,205 | A * | 6/1964 | Zwicky | 102/476 |
| 3,235,005 | A * | 2/1966 | Delacour | 166/299 |
| 3,675,575 | A * | 7/1972 | Bailey et al. | 102/306 |
| 5,221,808 | A * | 6/1993 | Werner et al. | 102/307 |
| 5,253,584 | A | 10/1993 | Allford | |
| 5,413,048 | A * | 5/1995 | Werner et al. | 102/307 |
| 5,501,154 | A * | 3/1996 | Rodney et al. | 102/331 |
| 6,354,219 | B1 * | 3/2002 | Pratt et al. | 102/307 |
| 6,634,300 | B2 * | 10/2003 | Reese et al. | 102/307 |
| 7,225,740 | B1 * | 6/2007 | Wood et al. | 102/214 |
| 7,262,734 | B2 * | 8/2007 | Wood | 343/701 |
| 7,278,354 | B1 * | 10/2007 | Langan et al. | 102/306 |
| 7,522,103 | B2 * | 4/2009 | Wood | 343/700 R |
| 7,638,006 | B2 * | 12/2009 | Wood | 149/37 |
| 7,656,989 | B2 * | 2/2010 | Wood et al. | 376/132 |
| 7,658,148 | B2 * | 2/2010 | Langan et al. | 102/306 |
| 7,749,345 | B2 * | 7/2010 | Wood | 149/37 |
| 7,819,064 | B2 * | 10/2010 | Saenger et al. | 102/310 |
| 7,849,919 | B2 * | 12/2010 | Wood et al. | 166/248 |
| 8,122,833 | B2 * | 2/2012 | Nielson et al. | 102/517 |
| 8,220,394 | B2 * | 7/2012 | Bates et al. | 102/476 |
| 2005/0134187 | A1 * | 6/2005 | Wood et al. | 315/111.21 |
| 2006/0038160 | A1 * | 2/2006 | Wood | 252/181.1 |
| 2007/0018894 | A1 * | 1/2007 | Wood | 343/701 |
| 2007/0044674 | A1 * | 3/2007 | Wood | 102/214 |
| 2007/0144392 | A1 * | 6/2007 | Wood et al. | 102/214 |
| 2008/0314732 | A1 * | 12/2008 | Wood et al. | 204/164 |
| 2009/0065109 | A1 * | 3/2009 | Wood | 149/2 |
| 2012/0174740 | A1 * | 7/2012 | Langan et al. | 86/20.1 |

* cited by examiner

*Primary Examiner* — Michael David
(74) *Attorney, Agent, or Firm* — Withrow & Terranova, PLLC

(57) ABSTRACT

An apparatus and method for generating a very bright white light source. The apparatus is a coruscative white light generator, comprising: a shaped charge liner; and a radial line-shaped charge that initiates coruscative reactions in the shaped charge liner. In one aspect, the method comprises initiating coruscative reactions in a shaped charge liner using a radial line-shaped charge. In another aspect, the method comprises subtending a significant portion of an observer field of view while denying said observer the ability to identify targets and/or aim optical devices through large area coverage of about 3,000 to about 5,000 Kelvin particles.

10 Claims, 4 Drawing Sheets

CORUSCATIVE WHITE LIGHT GENERATOR

CROSS-REFERENCE TO RELATED APPLICATIONS

The priority to U.S. Provisional Application Ser. No. 61/371,226, filed on Aug. 6, 2010, entitled "Coruscative White Light Generator," in the name of the inventor James Rick Wood is hereby claimed pursuant to 35 U.S.C. §119(e). This provisional application is also hereby incorporated by reference for all purposes as if set forth verbatim herein.

The priority to U.S. Provisional Application Ser. No. 61/371,813, filed on Aug. 9, 2010, entitled "Coruscative White Light Generator," in the name of the inventor James Rick Wood is hereby claimed pursuant to 35 U.S.C. §119(e). This provisional application is also hereby incorporated by reference for all purposes as if set forth verbatim herein.

STATEMENT REGARDING FEDERALLY SPONSORED RESEARCH OR DEVELOPMENT

Not applicable.

BACKGROUND OF THE INVENTION

The present disclosure generally pertains to a coruscative white light generator. More specifically, the present invention pertains to a coruscative apparatus for generating a white light and a method for use thereof.

SUMMARY OF THE INVENTION

The presently disclosed technique provides an apparatus and method for generating a very bright white light source. The apparatus is a coruscative white light generator, comprising: a shaped charge liner; and a radial line-shaped charge that initiates coruscative reactions in the shaped charge liner. In one aspect, the method comprises initiating coruscative reactions in a shaped charge liner using a radial line-shaped charge. The method comprises subtending a significant portion of an observer field of view while denying said observer the ability to identify targets and/or aim optical devices through large area coverage of about 3,000 to about 5,000 Kelvin particles.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The invention may be understood by reference to the following description taken in conjunction with the accompanying drawings, in which like reference numerals identify like elements, and in which.

Figure 1:
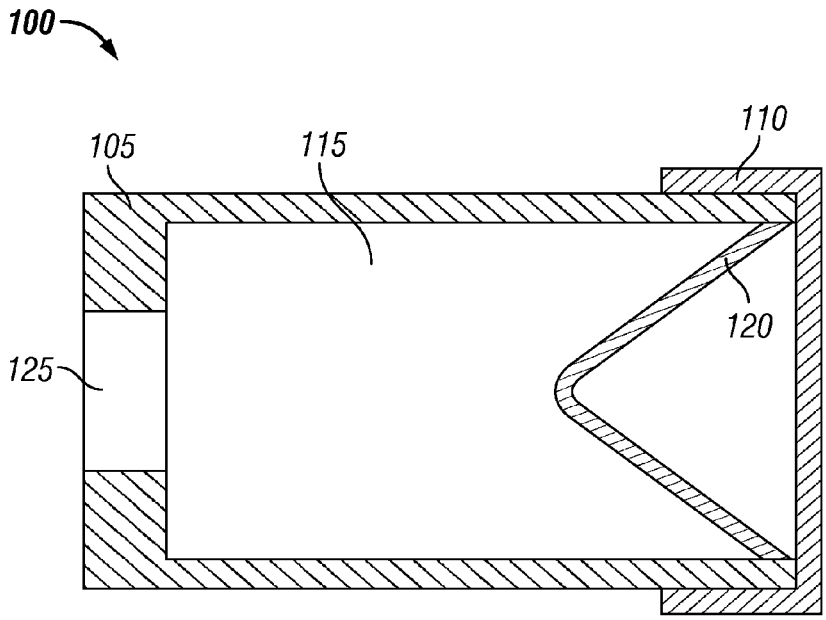
FIG. 1 is cross-sectional view of one embodiment of the present invention.

While the invention is susceptible to various modifications and alternative forms, the drawings illustrate specific embodiments herein described in detail by way of example. It should understood, however, that the description herein of specific embodiments in no intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Coruscative materials include metal and carbon-based mixtures and/or alloys of metal and carbon-based materials that undergo a non-outgassing reaction at elevated temperatures of at least about 2,500° C. (±10%), preferably at least about 3,000° C. (±10%). Generally, the reaction is non-outgassing and produces a solid or liquid reaction product.

The actual rate of reaction, the elevated temperature produced by the reaction, and the energy released varies depending on the metal and carbon-based materials in the composition. The rate of reaction is primarily a function of the size and packing density of the coruscative materials, e.g., the metal and carbon-based material, and secondarily a function of the stoichiometry of the reagents selected as the coruscative material. For example, smaller particles can be packed more closely together and at higher density. Thus, when the reactions starts, the smaller particles have a faster rate of transfer between adjacent particles of the initiating conditions for the coruscative reaction, whether the initiating condition is temperature, pressure or another parameter, than do larger particles with less packing density, e.g., more void space between particles or reagents. Sputtered or co-sputtered coruscative material demonstrated reactions rates at least 100×.

The temperature of the reaction is a function of the stoichiometry of the reagents selected as the coruscative material. The energy density is also a function of the stoichiometry of the reagents selected as the coruscative material. For example, a coruscative composition of a mixture of titanium (Ti) powder and carbon (C) powder combine to form TiC and release 6.6 kilo-cal per cc of reactants, e.g., energy density of 6.6 kilo-cal per cc. For comparison, TNT has an energy density of about 1.3 kilo-cal per cc.

It is contemplated that in some embodiments disclosed herein, materials that undergo a pyrotechnic and/or thermitic reaction may be used in combination with coruscative material.

The presently disclosed technique generates on demand a very bright white light source and subtending a significant portion of an observer field of view while denying said observer the ability to identify targets and/or aim optical devices. The technique provides a radial line-shaped charge that initiates coruscative reactions in the shaped charge liner, creating to large area coverage of about 3,000 to about 5,000 Kelvin particles. The explosive generation of high velocity particles subtends a larger area than flares and strobe lights, thereby subtending a greater part of observer field of view. Explosive generation creates white light much faster than flares.

Figure 2:
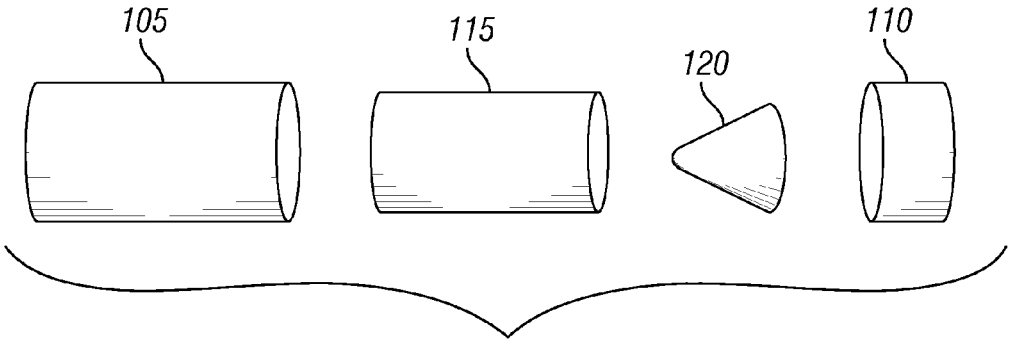
FIG. 2 is an exploded view of one embodiment of the present invention.

FIG. 1 illustrates a cross-sectional view of an exemplary shaped charge 100 according to the present invention. FIG. 2 is an exploded view of the exemplary shaped charge 100. A shaped charge is known in the art and generally utilizes a charge shape which focuses an explosive jet in a particular direction. Shaped charges commonly use a conical liner, which may be a metal, an alloy, or glass. Shaped charge 100 has a casing 105, preferably steel, which confines an explosive or shape charge liner 115. Disposed at one end of shaped charge 100 is a conical coruscative liner 120 and lock ring 110. Liner 120 may have an internal apex from about 40° to about 90°. Varying apex angles yield different distributions of jet mass and velocity. Disposed at the opposite end of shaped charge 100 is a detonation or ignition device area 125. A detonation or ignition device (not shown) may be any means known in the art, such as an electrical, mechanical or chemical source.

Shape charge liner 115, is fabricated from a high density explosive material, such as plasticized RDX or PBXN-9. Preferably, coruscative liner 120 is fabricated from materials which produce a solid to solid reaction, such as titanium and carbon, hafnium and carbon, titanium-zirconium and carbon, or tantalum and boron. The term solid refers to the solid state and can include a particle, a powder, or heat such as a bar, sheet or tube or can include an agglomerated or pressed and shaped particle, powder, or heat. It is contemplated that other coruscative materials could also be used, such as iron and aluminum, aluminum and potassium, calcium and silicon, aluminum and oxygen, titanium-boron and carbon, aluminum-sodium and oxygen, lead-oxygen and aluminum, zirconium and boron, hafnium and boron, and vanadium and boron.

Preferably, liner 120 is a powder liner which may compacted. Liner 120 may also be fabricated with a metal cone coated with alternating layers of coruscative materials deposited by vapor deposition or magnetron sputtering, may have a packed cavity with or without a slug, or any combination thereof. Tables 1 and 2 list some examples of suitable coruscative materials used as reactive agents and high density explosive materials used as propellants.

TABLE 1A

| | | | | Explosive Surface | | | | |
|---|---|---|---|---|---|---|---|---|
| Liner ID | Material System | Mass (grams) | Part Length (in) | Apex Radius (in) | Apex Radius CL (in-from base) | Cone Angle(°) | Cone Apex (in-from base) | Base Dia. (in) |
| Print | Hf + C | | 0.830 | 0.113 | 0.717 | 55.00 | 0.962 | 1.000 |
| 121504A | | 8.770 | 0.830 | 0.114 | 0.716 | 55.08 | 0.960 | 1.001 |

TABLE 1B

| | Free Surface | | | | | | |
|---|---|---|---|---|---|---|---|
| Liner ID | Apex Radius (in) | Apex Radius CL (in-from base) | Cone Angle(°) | Cone Apex (in-from base) | $2^{nd}$ Cone Angle(°) | $2^{nd}$ Cone Apex (in-from base) | Base Dia. (in) |
| Print | 0.066 | 0.716 | 54.96 | 0.859 | | | 0.894 |
| 121504A | 0.668 | 0.714 | 54.97 | 0.860 | | | 0.894 |

TABLE 1C

| | | Wall Thickness | | | | |
|---|---|---|---|---|---|---|
| Liner ID | Apex Thickness (in) | 0 (in) | 90 (in) | 180 (in) | 270 (in) | Variation (in) |
| Print | 0.048 | 0.047 | 0.047 | 0.047 | 0.047 | |
| 121504A | 0.048 | 0.047 | 0.047 | 0.047 | 0.047 | 0.0001 |

TABLE 2

| Propellants and Explosives with Solid or Liquid Reaction Products | | | | | | |
|---|---|---|---|---|---|---|
| Reactive Agent | $q_m$ kcal/g | $q_m$ kJ/g | ρ g/cm$^3$ | $q_v$ kcal/cm$^3$ | $q_v$ kJ/cc | Commercial Name |
| Ti + C = TiC | 1.83 | 7.66 | 3.66 | 6.70 | 28.04 | Titanium + Carbon Coruscative |
| $Fe_2O_3$ + 2Al = 2Fe + $Al_2O_3$ | 0.85 | 3.56 | 4.75 | 4.04 | 16.90 | Thermit |
| **Propellants and Explosives with Gaseous Reaction Products** | | | | | | |
| Propellant | $q_m$ kcal/g | $q_m$ kJ/g | ρ g/cm$^3$ | $q_v$ kcal/cm$^3$ | $q_v$ kJ/cc | Commercial Name |
| $C_6H_5N_3O_7$ TNT | 0.63 | 2.64 | 1.65 | 1.04 | 4.35 | 2-methyl-1,3,5-trinitrobenzene, TNT, alpha-trinitrotoluol, tolite |
| $C_3H_6N_6O_6$ RDX | 1.22 | 5.11 | 1.82 | 2.22 | 9.30 | Cyclotrimethylene-trinitramine, Cyclonite, Hexogen, Composition |
| $C_3H_5N_3O_9$ Nitroglycerin | 1.51 | 6.32 | 1.59 | 2.40 | 10.05 | 1,2,3-Propanetriol trinitrate, Glyceryltrinitrate, NG, Nitroglycerin |
| $C(CH_2ONO_2)_4$ PETN | 1.40 | 5.86 | 1.77 | 2.48 | 10.37 | Pentaerythritol Tetranitrate, PETN |
| $C_7H_5N_5O_8$ Tetryl | 0.87 | 3.64 | 1 73 | 1 51 | 6.30 | |

One of the benefits of constructing a white light generator fabricated from coruscative materials is that the invention may be practiced with any known detonation or ignition device, therefore, no power supply may be needed. Another benefit is that only a small mass and volume of materials is needed to produce a self contained light source. For example, coruscative materials can generate six times the energy per volume than TNT. They can also generate three times the energy per mass than TNT. The rate of energy released is controllable by coruscative particle size or by coating methods. A suitable particle size can be selected to achieve a desired packing density. The particles can be formed by forming a solid composition of coruscative material by pressing and sintering or by alloying, and ball milling the solid composition to the desired particle size.

Particles may also be arranged as multi-layers having a first layer of coruscative material and then a separator layer, such as a polymeric material. The layers may be deposited on a substrate, such as conical liner or tape made of an appropriate material. Preferably, the layers are deposited by magnetron sputtering or chemical vapour deposition in essentially oxygen-free environments such as a vacuum or a low pressure inert atmosphere, such as argon, to prevent the formation of an inhibiting film of metal oxide between the coruscative and polymeric material. This maximizes molecular intermingling of the polymeric and coruscative materials at their interface to provide a large, intimate and essentially void-free contact area between the two.

Controlling particle size and density allows for desired detonation rates of the coruscative white light generator from a few meters per second to several hundred meters per second. For example, shot velocities from about Mach 1 to about Mach 20 have been demonstrated in testing. Coruscative detonation reaction products release energy as radiation. Radiation energy can also be tuned from about 3,000K to about 5,000K depending on the selection of coruscative reaction materials. For example, Ta+2B produces about a 4,700K reaction. Therefore, a large volume of plasma may be generated from a small volume and mass of coruscative materials. Furthermore, the white light generation is tunable in temperature and rate through selection in coruscative reaction element products, particle size, and/or coating method.

Figure 3:
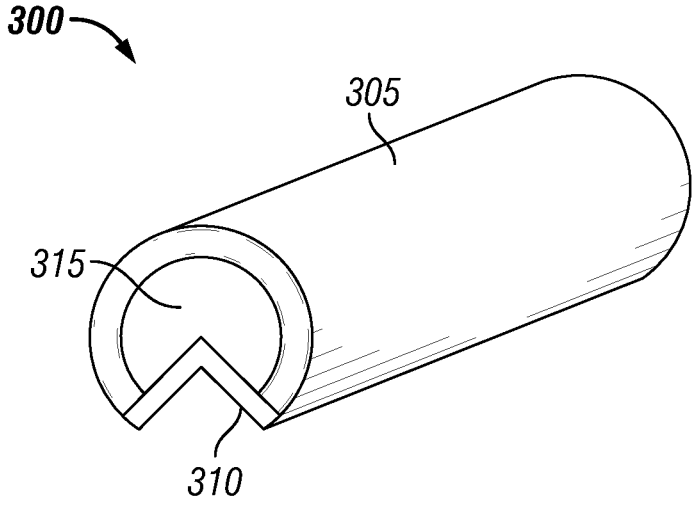
FIG. 3 is a perspective view of an alternate embodiment of the present invention.

FIG. 3 is a perspective view of an exemplary linear shaped charge 300 according to the present invention. Typically, a linear shaped charge has a V-shaped liner which is surrounded by explosive and encased within a confinement of suitable material. A linear shaped charge produces a continuous planar jet. In this alternate embodiment, shaped charge 300 has an outer casing 305 made of steel or a comparable metallic material or alloy. Disposed within casing 305, is explosive or shape charge liner 315. Preferably, linear shaped charge 300 has a V-shaped coruscative liner 310 disposed on one side of shaped charge 300. It is contemplated that linear shaped charge 300 could be deployed to produce a sheet of plasma along a desired plane.

Figure 4:
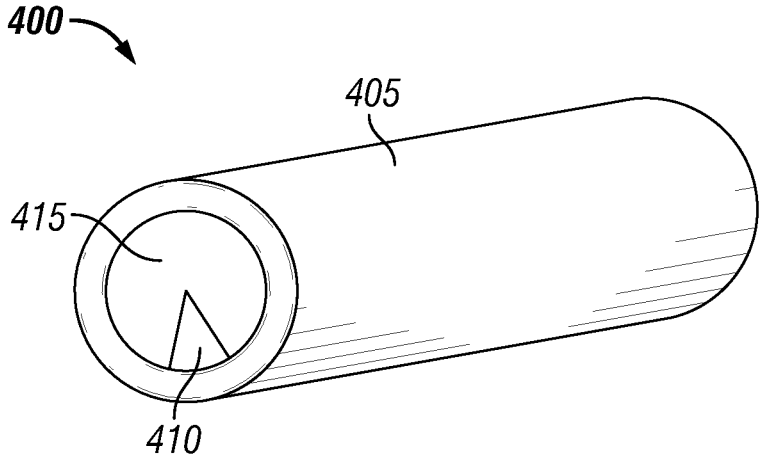
FIG. 4 is perspective view of the preferred embodiment of the present invention.

FIG. 4 is perspective view of the preferred embodiment of the present invention. White light generator 400 has an outer casing 405. Disposed within casing 405 is a high density explosive or radial line-shaped charge 415, such as plasticized RDX or PBXN-9. Further disposed within casing 405 is coruscative shaped charge liner 410. Liner 410 may be fabricated by any of the means previously discussed above. Once shaped charge 400 is detonated, by means of a mechanical or chemical train, or electrical impulse, radial line-shaped charge 415 initiates the coruscative reactions in shaped charge liner 410. Radial line-shaped charge 415 may be fabricated by closing a linear shaped charge, such as in FIG. 3, so that the V-shaped liner is compressed onto itself forming charge liner 410. Alternatively, charge liner 410 may be fabricated as one continuous element or V-shaped wedge. In this manner, the resulting plasma is ignited radially about the apparatus.

Figure 5:
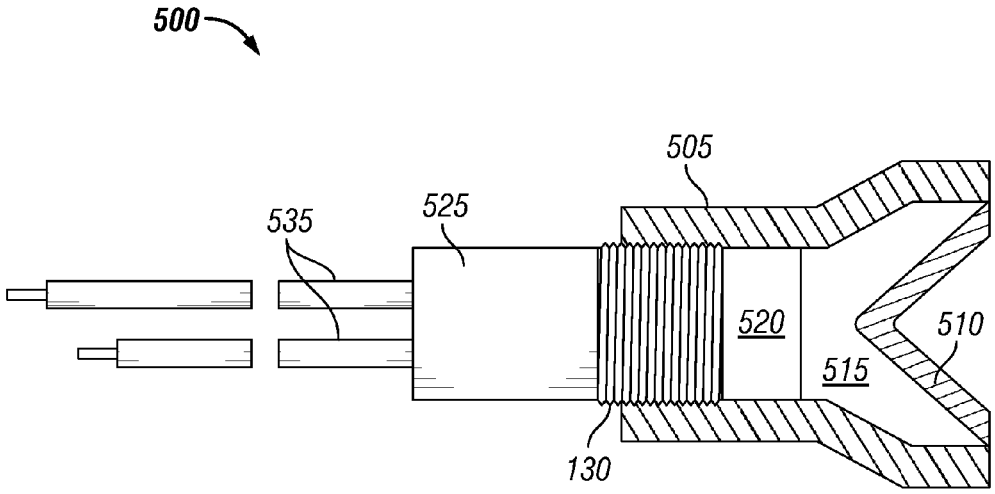
FIG. 5 is a cross-sectional view of an alternate embodiment of the present invention.

FIG. 5 is a cross-sectional view of yet another alternate embodiment of the present invention. White light generator 500 has an outer casing 505 which mates with a connective casing 525 at one end by a mechanical means 530, such as threading, and forms a seal. Preferably, outer casing 505 and connective casing 525 have a maximum length of about 1.85 inches. Further disposed at the opposite end of connective casing 525 are electrical detonation leads 535. However, detonation leads 535 are exemplary in nature and detonation or ignition may be by any known mechanical, chemical or electrical source. Alternatively, igniter 520 is an optional feature. Other suitable igniters include electrical ignition sources, impact ignition sources and other munition igniters. The opposite end of outer casing 505 has an expanded circumference, preferably a maximum diameter of about one inch, to accommodate shaped charge 515, coruscative liner 510 and initiating explosive 520 disposed within casing 505. Preferably, shaped charged 515 is fabricated from plasticized RDX and initiating explosive 520 is fabricated from PETN.

Note that shaped charges suitable for modification and implementation in the present techniques as described above are well known in the incendiary arts. They are also commercially available off the shelf. Any suitable shaped charge known to the art may be used. Those ordinarily skilled in the art having the benefit of this disclosure will recognize which are suitable given the specific design constraints of their implementation in light of the discussion of design considerations set forth herein.

It is contemplated that a white light generator of approximate proportions as described herein would be appropriate to affix to weapons such as shot guns, rocket propelled grenade launchers or other comparable sized shoulder weapons, but is in no way intended to be limiting in scope.

Figure 6A:
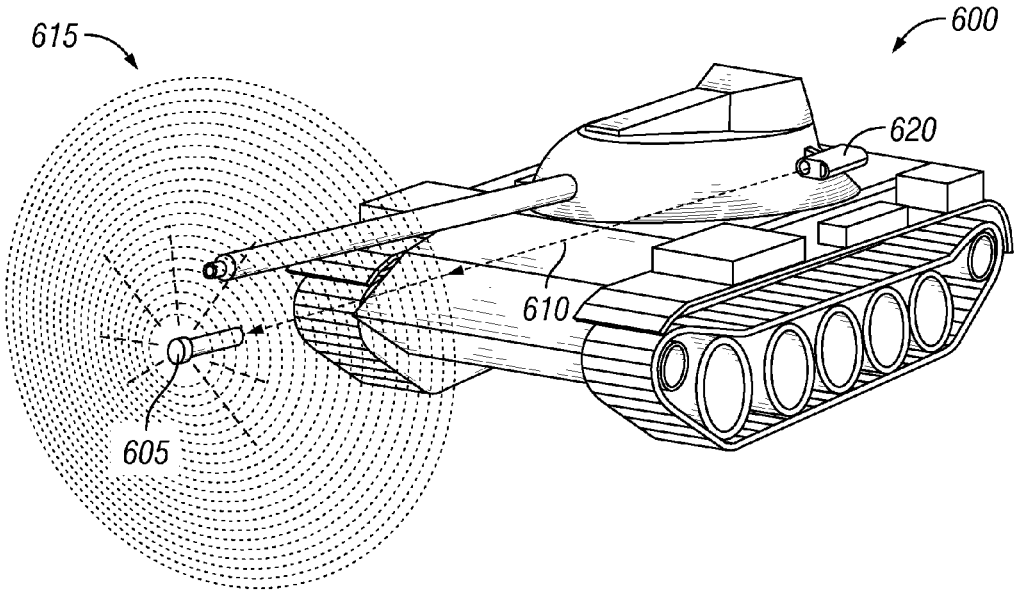
FIG. 6A depicts one particular end use for the disclosed technique.

FIG. 6A depicts one particular end use for the disclosed technique. In this example, coruscative white light generator 605 is deployed from armored vehicle 600 from launch port 620 in the direction of arrow 610. Detonation of white light generator 605 is slightly delayed to allow white light generator 605 to clear armored vehicle 600 and ensure no damage to the vehicle from the resulting plasma 605. Plasma 605 is ignited radially about white light generator 605 creating a very bright white light source. Plasma 605 subtends a significant portion of an observer field of view while denying said observer the ability to identify targets and/or aim optical devices at armored vehicle 600. Exemplary white light generator 605 has a radial line-shaped charge that initiates coruscative reactions in the shaped charge liner, creating large area coverage of about 3,000 to about 5,000 Kelvin particles.

The explosive generation of high velocity particles subtends a larger area than flares and strobe lights, thereby subtending a greater part of observer field of view. Explosive generation also creates white light much faster than flares and has been demonstrated in testing from about Mach 1 to about Mach 20, depending on the coruscative materials selected, particle size and density of the particles. In this example, a six meter diameter plasma sheet is deployed in 500 μsec at Mach 20.

Figure 6B:
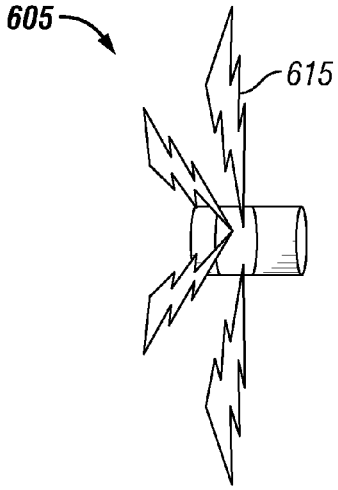
FIG. 6B is a perspective view of an embodiment of the coruscative white light generator used in FIG. 6A.

FIG. 6B is a perspective view of the exemplary coruscative white light generator 605 used in the instant technique. Plasma 615 is deployed radially about white light generator 605 creating a plasma sheet in front of armored vehicle 600. The resulting continuous incandescent plasma sheet spoils observer vision and requires time for the observer to recovery from the optical distortion created by the bright white light.

The above method of use is provided by way of example. However, other methods to provide active protection with incandescent/coruscative submunitons are also contemplated without deviating from the scope of the invention. Alternatively, an array white light generators could be affixed to a platform or armored vehicle. In this fashion, the white light generators could be replaced or reloaded once consumed. The white light generator according to the instant invention is a smaller and lighter solution to known flares and strobe lights.

As previously discussed, the invention could be practiced with shoulder weapons and grenade launchers, such tactical unmanned ground vehicles, for optical countermeasures since the white light generates a large subtended angle source rather than a point source. The large area light source is difficult to block or filter the light energy across significant portions of an observer field of view. Therefore, objects can be hidden behind the large area light source while the observer is denied aimpoint selection and optically aimed weapons are denied target signatures.

Other benefits to the white light generator according to the invention include cost reductions associated high energy power supplies and that a single device can cover the same area as multiple flares or laser strobes. Performance improvement has been demonstrated since a small explosive shaped charge can be detonated on a vehicle to be protected removing the need for multiple launchers. Loadout is also improved due to the small volume of the device. It is also contemplated that the white light generator according to the invention may have application as an alternative to large area strobe photography and undersea strobe photography.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A method for generating a coruscative white light to obscure a vehicle from a remote observer for a period of time, comprising:

affixing a shaped charge to the vehicle, the shaped charge comprising a casing, a line-shaped charge positioned in an interior of the casing and a shaped coruscative liner fabricated from a coruscative material;

detonating the shaped charge while the shaped charge is affixed to the vehicle to initiate a coruscative reaction and generate a white light between the vehicle and the remote observer.

2. The method of claim 1, wherein initiating the coruscative reaction results in subtending a significant portion of a field of view of the remote observer while denying said remote observer an ability to identify targets or aim optical devices.

3. The method of claim 1, wherein initiating the coruscative reaction results in creating large area coverage of about 3,000 to about 5,000 Kelvin particles.

4. The apparatus of claim 1, wherein the shaped coruscative liner is V-shaped.

5. The apparatus of claim 1, wherein the V-shaped coruscative liner is V-shaped in its longitudinal dimension.

6. The apparatus of claim 1, wherein the V-shaped coruscative liner is V-shaped in its transverse dimension.

7. The apparatus of claim 1, wherein the shaped coruscative liner is shaped like a pie piece.

8. The method of claim 1, further comprising:

affixing a plurality of shaped charges to the vehicle in an array, and wherein detonating the shaped charge while the shaped charge is affixed to the vehicle further comprises concurrently detonating the plurality of shaped charges while the plurality of shaped charges are affixed to the vehicle.

9. A method for generating a coruscative white light to obscure a platform from an observer for a period of time, comprising:

affixing a shaped charge to the platform, the shaped charge comprising a casing, a line-shaped charge positioned in an interior of the casing and a shaped coruscative liner fabricated from a coruscative material;

detonating the shaped charge while the shaped charge is affixed to the platform, thereby subtending a significant portion of a field of view of the observer while denying said observer an ability to identify the platform for the period of time.

10. The method of claim 9, further comprising:

affixing a plurality of shaped charges to the platform in an array, and wherein detonating the shaped charge while the shaped charge is affixed to the platform further comprises concurrently detonating the plurality of shaped charges while the plurality of shaped charges are affixed to the platform.

* * * * *

UNITED STATES PATENT AND TRADEMARK OFFICE

CERTIFICATE OF CORRECTION

PATENT NO. : 8,621,999 B1
APPLICATION NO. : 13/187047
DATED : January 7, 2014
INVENTOR(S) : James R. Wood It is certified that error appears in the above-identified patent and that said Letters Patent is hereby corrected as shown below:

In the Claims

In claim 5 replace:

"The apparatus of claim 1, wherein the V-shaped coruscative liner is V-shaped in its longitudinal dimension." with --"The apparatus of claim 4, wherein the V-shaped coruscative liner is V-shaped in its longitudinal dimension."--.

In claim 6 replace:

"The apparatus of claim 1, wherein the V-shaped coruscative liner is V-shaped in its transverse dimension." with --"The apparatus of claim 4, wherein the V-shaped coruscative liner is V-shaped in its transverse dimension."--.

Signed and Sealed this
Third Day of June, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,621,999 B1
APPLICATION NO. : 13/187047
DATED : January 7, 2014
INVENTOR(S) : James R. Wood It is certified that error appears in the above-identified patent and that said Letters Patent is hereby corrected as shown below:

In the Claims

Col. 8, lines 50-51,
In claim 5 replace:

"The apparatus of claim 1, wherein the V-shaped coruscative liner is V-shaped in its longitudinal dimension." with --"The apparatus of claim 4, wherein the V-shaped coruscative liner is V-shaped in its longitudinal dimension."--.

Col. 8, lines 52-53,
In claim 6 replace:

"The apparatus of claim 1, wherein the V-shaped coruscative liner is V-shaped in its transverse dimension." with --"The apparatus of claim 4, wherein the V-shaped coruscative liner is V-shaped in its transverse dimension."--.

This certificate supersedes the Certificate of Correction issued June 3, 2014.

Signed and Sealed this
First Day of July, 2014

Michelle K. Lee

Michelle K. Lee
*Deputy Director of the United States Patent and Trademark Office*